US011448370B2

(12) United States Patent
Jiang et al.

(10) Patent No.: US 11,448,370 B2
(45) **Date of Patent: *Sep. 20, 2022**

(54) LED LIGHT BULB

(71) Applicant: XIAMEN ECO LIGHTING CO. LTD., Xiamen (CN)

(72) Inventors: Hongkui Jiang, Xiamen (CN); Yanzeng Gao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/164,052

(22) Filed: Feb. 1, 2021

(65) Prior Publication Data

US 2021/0148519 A1 May 20, 2021

Related U.S. Application Data

(63) Continuation of application No. 16/725,156, filed on Dec. 23, 2019, now Pat. No. 10,935,189, which is a continuation of application No. 15/944,757, filed on Apr. 3, 2018, now Pat. No. 10,551,007.

(51) Int. Cl.

| | |
|---|---|
| ***F21K 9/238*** | (2016.01) |
| ***F21K 9/90*** | (2016.01) |
| ***F21K 9/235*** | (2016.01) |
| ***F21V 19/00*** | (2006.01) |
| ***F21K 9/237*** | (2016.01) |
| ***F21Y 115/10*** | (2016.01) |

(52) U.S. Cl.

CPC ..... *F21K 9/238* (2016.08); *F21K 9/235* (2016.08); *F21K 9/237* (2016.08); *F21K 9/90* (2013.01); *F21V 19/003* (2013.01); *F21Y 2115/10* (2016.08)

(58) Field of Classification Search

CPC ..... F21V 19/003; F21V 17/00; F21V 19/00; F21V 19/001; F21V 19/0015; F21V 19/0025; F21V 19/0035; F21Y 2115/10; F21K 9/232; F21K 9/90; F21K 9/238; F21K 9/235; F21K 9/237

See application file for complete search history.

(56) References Cited

U.S. PATENT DOCUMENTS 10,935,189 B2 * 3/2021 Jiang ..... F21K 9/237

* cited by examiner

*Primary Examiner* — Anne M Hines
*Assistant Examiner* — Jose M Diaz
(74) *Attorney, Agent, or Firm* — Chun-Ming Shih; Lanway IPR Services

(57) ABSTRACT

The lighting device includes at least one filament module, a base, at least one pillar, and a base. The filament module includes more than two filaments. Each filament includes a substrate, multiple LED chips, a phosphor film, a top extended electrode, and a bottom extended electrode. Multiple LED chips are mounted on the substrate. The phosphor film covers the substrate and multiple LED chips. The top extended electrode and bottom extended electrode are connected to two ends of the substrate respectively. At least part of top extended electrode and bottom extended electrode are not covered by the phosphor film, and each top extended electrode of the filaments is fixed together.

16 Claims, 6 Drawing Sheets

LED LIGHT BULB

RELATED APPLICATION

The present application is a continuation application of U.S. application Ser. No. 16/725,156, which is a continued application of U.S. application Ser. No. 15/944,757.

FIELD OF THE INVENTION

The present invention relates to a lighting device and a manufacturing method of lighting devices, and more particularly to a LED (Light emitting diode) lighting device and a manufacturing method of LED lighting devices.

BACKGROUND

Lighting is an important part of human life. Since Thomas Edison has invented electric lighting, the life of human being was widely changed. With the improvement in LED (Light emitting diode) technology and the decrease in cost, LED technology rapidly extends to various light fixtures and applications.

Compared with traditional incandescent light bulbs, LED usually has better luminous efficacy. However, LED components have limitations in heat resistance. If the problems of heat dissipation can be solved effectively, the life span of LED and the stability of light fixtures would be greatly improved.

Light bulbs are an important part of a light fixture. Because light bulbs are used for a long period, people have given impressions and preferences of the shape of light bulbs. Currently there are LED light bulbs designed to resemble traditional incandescent light bulbs in the market. However, the production process of LED light bulbs similar to incandescent light bulbs in appearance often faces the problems of weak structures and complicate assembly.

The present invention focuses on the technical problems of these kind of light bulbs. The present invention shows improvements in cost, reliability of products, and production cost.

SUMMARY OF INVENTION

The present invention provides an improved lighting device according to the first embodiment of the present invention. The lighting device includes at least one filament module, a base, at least one pillar, and a base.

The filament module includes more than two filaments. Each filament includes a substrate, multiple LED chips, a phosphor film, a top extended electrode, and a bottom extended electrode. Multiple LED chips are mounted on the substrate. The phosphor film covers the substrate and multiple LED chips. The top extended electrode and bottom extended electrode are connected to two ends of the substrate respectively. At least part of top extended electrode and bottom extended electrode are not covered by the phosphor film, and each top extended electrode of the filaments is fixed together.

The bottom of the pillar is connected to the base. Multiple top extended electrodes of the filaments of the filament module hang on the top of the pillar. A driver circuit electrically connects to multiple bottom extended electrodes of the filaments of the filament module. The base contains the driver circuit. The base is used to connect to the power.

In some embodiments, multiple top extended electrodes of the filaments of the filament module may connect to each other, then the combination of multiple top extended electrodes connects to the top of the pillar. In other words, the highest parts of the filaments may be assembled first, then the highest parts of the filaments are fixed to the top of the pillar.

In some embodiments, multiple top extended electrodes of the filaments of the filament module are integrally formed. In this kind of manufacturing method, the stability and conductivity of the filament are further improved, and the unnecessary problem of temperature increase gets better.

In some embodiments, the connection part of the top extended electrodes of multiple filaments may have a ring. The ring is put into the top of the pillar.

In some embodiments, the top extended electrode of the filament is made with a ring, and the top of the pillar is inserted into the ring. In other words, compared with traditional method of fixing the stick electrodes by welding, this method further improves the stability of the filaments.

In some embodiments, the number of the pillar is more than two, and multiple fila In some embodiments, the pillar is a thin piece of metal. For example, the pillar may be made of iron-nickel alloys with certain hardness.

In some embodiments, the top of the pillar includes an insulation part. The insulation part has a support structure used to hold multiple top extended electrodes of the filaments of the filament module. In other words, the insulation part avoids a short circuit, causing by assembly or vibration, when certain filaments are electrically connected.

In some embodiments, the above-mentioned insulation part may be made of glass.

In some embodiments, the pillar in the area of insulation part may be all made of glass.

In some embodiments, the insulation part is made of plastic. Plastic may further reduce the overall cost. Plastic are easier to produce a relatively complicated stand, and the stand is used to support and fix the connection parts of the filaments.

In some embodiments, the support structure is a slot at the top of the insulation part. In other words, the mounting of the filaments becomes more stable with gloves, holes, and soon.

In some embodiments, the support part of the pillar is an extended component set in the insulation part. For example, the support part may be made out of metal sticks, and the pillar may be made of plastic or metal. The support part, like metal sticks and so on, is set in the pillar in the production process of the pillar. In this way, the stability is improved, and the complexity of assembly is reduced.

In some embodiments, the extended component is a metal stick. The extended component includes an inner part and an extended part. The inner part of the extended component is set in the insulation part. The extended part of the extended component is stretched away from the insulation part. The top extended electrodes of multiple filaments of the filament module hang on the extended part of the extended component.

In some embodiments, a bottom electrical connection structure extends from the base. The bottom electrical connection structure electrically connects to the driver circuit. The bottom extended electrodes of multiple filaments of the filament module electrically connect to the bottom electrical connection structure, and multiple filaments are electrically connected in series or parallel.

In some embodiments, the bottom electrical connection structure has an annular metallic strip. By cutting off the annular metallic strip, multiple filaments are electrically connected in series or parallel.

In some embodiments, the bottom extended electrodes of multiple filaments are fixed to the bottom electrical connection structure and thus to allow the angle between each filament and the pillar to be more than fifteen degrees.

In some embodiments, an insulator is put over a pair of connection parts of the top extended electrodes of the filaments, and another a pair of connection parts of the top extended electrodes of the filaments are fixed to the pillar over the insulator.

The present invention provides a manufacturing method of a lighting device according to another view of the present invention. The manufacturing method includes steps as follows.

A filament module is provided. The filament module includes at least two filaments. The filament includes a substrate, multiple LED chips, a phosphor film, a top extended electrode, and a bottom extended electrode. Multiple LED chips are mounted on the substrate. The phosphor film covers the substrate and multiple LED chips. The top extended electrode and bottom extended electrode are connected to two ends of the substrate respectively. At least part of top extended electrode and bottom extended electrode are not covered by the phosphor film. Each top extended electrode of the filaments is fixed together.

One or multiple filament modules are fixed to the pillar of the lighting device. The pillar is mounted on the base of the lighting device.

In some embodiments, this manufacturing method further includes a producing way of cutting a metal plate to produce the substrate, the top extended electrode, and the bottom extended electrode of the filament modules.

According to different embodiments as above, the present invention makes it possible to decrease the cost with varying degrees, improve the stability of filaments, and simplify the production process.

DETAILED DESCRIPTION

Figure 1:
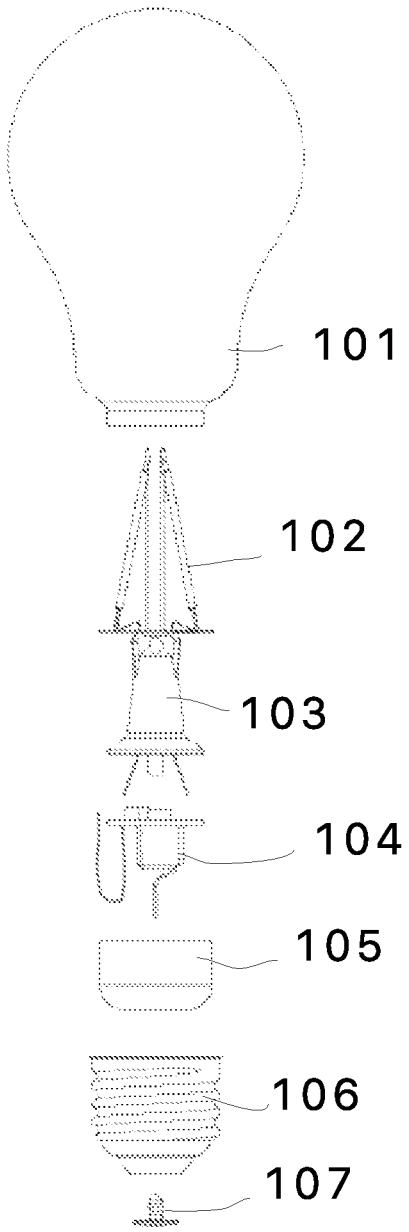
FIG. 1 illustrates an embodiment of lighting device.

Firstly, please refer to FIG. 1. FIG. 1 is an exploded perspective view of lighting device components according to an embodiment of the present invention.

Figure 2A:
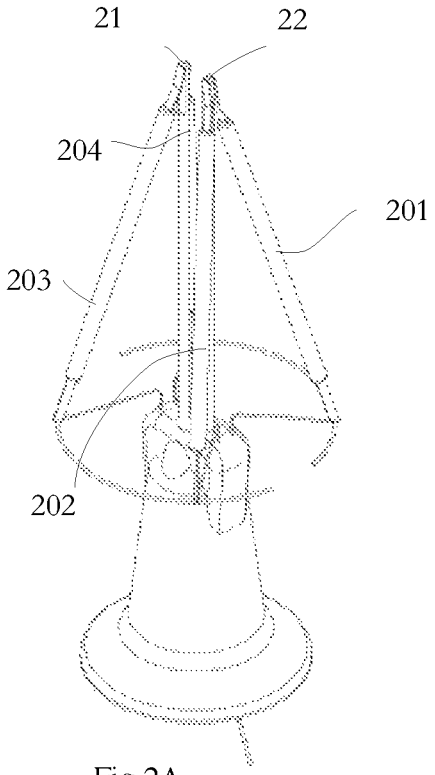
FIG. 2A illustrates a connection way of filaments.
Figure 2B:
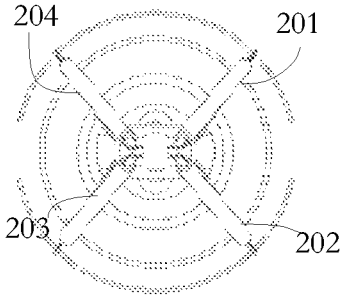
FIG. 2B is a top view of FIG. 2A.

In the lighting device of FIG. 1, multiple filaments 102 are set in a cover 101. One end of multiple filaments 102 are fixed to the upper end of the pillar, and the other ends of multiple filaments 102 are fixed to the base 103. The driver circuit 104 is set in the heat exchanger cup 105. The heat exchanger cup 105 is set in the base 106. The base 106 connects to the external power supply such as standard Edison lamp holder through the electrical foot contact 107 and the side electrode Please refer to FIG. 2A and FIG. 2B. FIG. 2A shows a connection type of filaments. FIG. 2B is a top view of FIG. 2A.

In FIG. 2A and FIG. 2B, the top extended electrodes of four filaments 201, 202, 203, 204 connect as in the drawings, the top extended electrodes of four filaments 201, 202, 203, 204 are fixed to the pillar 21, 22. Four filaments 201, 202, 203, 204 are electrically connected as planned through an annular metallic support strip extended from the base.

In this embodiment, two of filaments 201, 202, 203, 204 are electrically connected in series, while others are electrically connected in parallel. The annular metallic support strip extended from the base may be cut off according to different connection types. In other words, the annular metallic support strip as in the drawings may be cut off according to different connection types of filaments in the production process, thus to form different connection types of filaments.

Figure 3A:
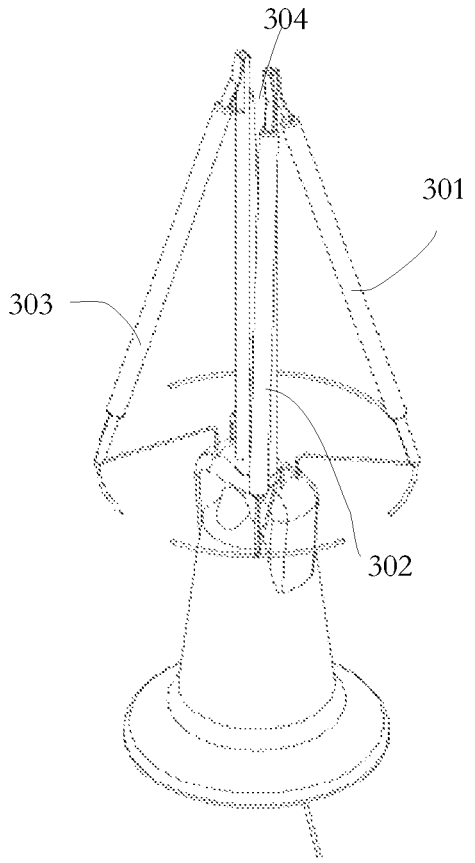
FIG. 3A illustrates another connection way of filaments.
Figure 3B:
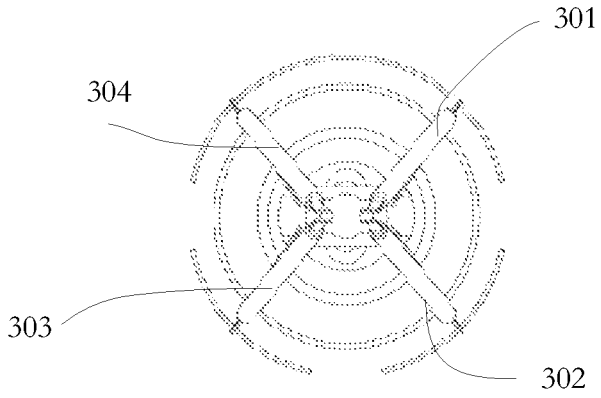
FIG. 3B is a top view of FIG. 3A

Please refer to FIG. 3A and FIG. 3B. FIG. 3A illustrates another connection way of filaments. FIG. 3B is a top view of FIG. 3A.

Four filaments 301, 302, 303, 304 of FIG. 3A and FIG. 3B are electrically connected in series. Compared with the embodiment of FIG. 2A and FIG. 2B, the connection type of the tops of the filaments and annular metallic support strip extended from the base are roughly similar, two embodiments differ in the way of cutting off annular metallic support strip.

In other words, in these embodiments, the annular metallic support strips are basically the same, and the base with the same annular metallic support strip may be produced in large numbers. In the subsequent production process, a series connection or a parallel connection are formed by changing the break point of the annular metallic support strip or changing the connection type between the filaments and the annular metallic support strip. This method significantly reduces the production cost.

Figure 4A:
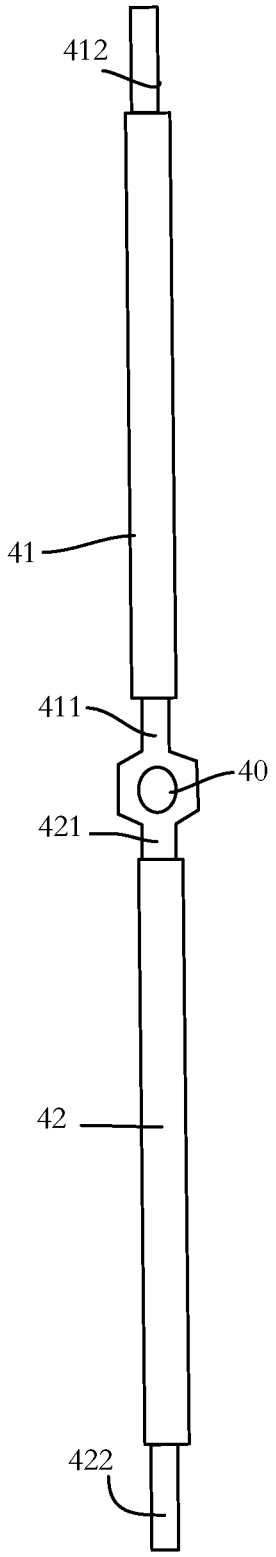
FIG. 4A illustrates an embodiment of filaments.

FIG. 4A shows an embodiment of filaments.

In FIG. 4A, two top extended electrodes 411, 421 are connected to the filament 41, 42 respectively, each top extended electrode and filament are manufactured in pair, or each top extended electrode is fixed to the filament before the top extended electrode is fixed to the pillar. In this embodiment of FIG. 4A, there is a ring between the top extended electrodes 411, 421. The ring is put into the top of the pillar directly, the stability of fixing is strengthened, and the production process accelerates.

In other words, with this filament structure, people just make the top extended electrodes of the filaments hang on or weld to the top of the pillar, then make the bottom extended electrodes 422, 412 connect to the base, such as the annular metallic support strip as above.

Figure 4B:
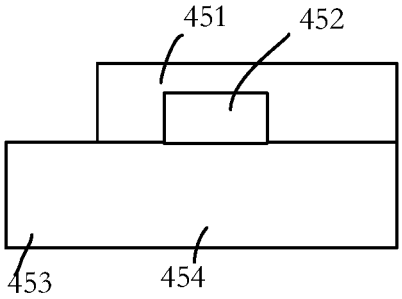
FIG. 4B is a partial perspective view of filaments.

FIG. 4B is a partial perspective view of filaments. The filament includes a substrate 454. A LED module 452 is mounted on the substrate, and the phosphor film 451 is set on the substrate. Two ends of the substrate 454 are formed into electrodes 453.

Figure 5:
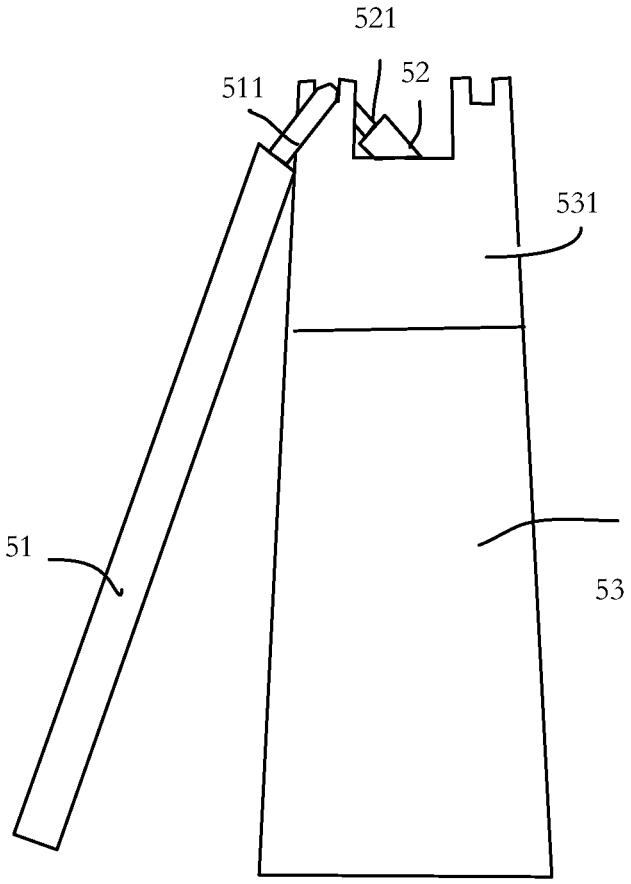
FIG. 5 illustrates an embodiment of fixing filaments.

FIG. 5 shows an embodiment of fixing the filaments.

In FIG. 5, the top extended electrodes 511, 521 of the filaments 51, 52 are fixed together, then the top extended electrodes 511, 521 are put at the top 531 of the pillar 53. In this embodiment, the top 531 of the pillar 53 is insulated and provided with a slot.

The present invention provides an improved lighting device according to the first embodiment of the present invention. The lighting device includes at least one filament module, a base, at least one pillar, and a base.

The filament module includes more than two filaments. Each filament includes a substrate, multiple LED chips, a phosphor film, a top extended electrode, and a bottom extended electrode. Multiple LED chips are mounted on the substrate. The phosphor film covers the substrate and multiple LED chips. The top extended electrode and bottom extended electrode are connected to two ends of the substrate respectively. At least part of top extended electrode and bottom extended electrode are not covered by the phosphor film, and each top extended electrode of the filaments is fixed together.

The bottom of the pillar is connected to the base. Multiple top extended electrodes of the filaments of the filament module hang on the top of the pillar. A driver circuit electrically connects to multiple bottom extended electrodes of the filaments of the filament module. The base contains the driver circuit. The base is used to connect to the power.

In some embodiments, multiple top extended electrodes of the filaments of the filament module may connect to each other, then the combination of multiple top extended electrodes connects to the top of the pillar. In other words, the highest parts of the filaments may be assembled first, then the highest parts of the filaments are fixed to the top of the pillar.

In some embodiments, multiple top extended electrodes of the filaments of the filament module are integrally formed. In this kind of manufacturing method, the stability and conductivity of the filament are further improved, and the unnecessary problem of temperature increase gets better.

In some embodiments, the connection part of the top extended electrodes of multiple filaments may have a ring. The ring is put into the top of the pillar.

In some embodiments, the top extended electrode of the filament is made with a ring, and the top of the pillar is inserted into the ring. In other words, compared with traditional method of fixing the stick electrodes by welding, this method further improves the stability of the filaments.

In some embodiments, the number of the pillar is more than two, and multiple filaments hang on the tops of the pillars.

In some embodiments, the pillar is a thin piece of metal. For example, the pillar may be made of iron-nickel alloys with certain hardness.

In some embodiments, the top of the pillar includes an insulation part. The insulation part has a support structure used to hold multiple top extended electrodes of the filaments of the filament module. In other words, the insulation part avoids a short circuit, causing by assembly or vibration, when certain filaments are electrically connected.

In some embodiments, the above-mentioned insulation part may be made of glass.

In some embodiments, the pillar in the area of insulation part may be all made of glass.

In some embodiments, the insulation part is made of plastic. Plastic may further reduce the overall cost. Plastic are easier to produce a relatively complicated stand, and the stand is used to support and fix the connection parts of the filaments.

In some embodiments, the support structure is a slot on the top of the insulation part. In other words, the mounting of the filaments becomes more stable with gloves, holes, and soon.

In some embodiments, the support part of the pillar is an extended component set in the insulation part. For example, the support part may be made out of metal sticks, and the pillar may be made of plastic or metal. The support part, like metal sticks and so on, is set in the pillar in the production process of the pillar. In this way, the stability is improved, and the complexity of assembly is reduced.

In some embodiments, the extended component is a metal stick. The extended component includes an inner part and an extended part. The inner part of the extended component is set in the insulation part. The extended part of the extended component is stretched away from the insulation part. The top extended electrodes of multiple filaments of the filament module hang on the extended part of the extended component.

In some embodiments, a bottom electrical connection structure extends from the base. The bottom electrical connection structure electrically connects to the driver circuit. The bottom extended electrodes of multiple filaments of the filament module electrically connect to the bottom electrical connection structure, and multiple filaments are electrically connected in series or parallel.

In some embodiments, the bottom electrical connection structure has an annular metallic strip. By cutting off the annular metallic strip, multiple filaments are electrically connected in series or parallel.

In some embodiments, the bottom extended electrodes of multiple filaments are fixed to the bottom electrical connection structure and thus to allow the angle between each filament and the pillar to be more than fifteen degrees.

In some embodiments, an insulator is put over a pair of connection parts of the top extended electrodes of the filaments, and another a pair of connection parts of the top extended electrodes of the filaments are fixed to the pillar over the insulator.

Figure 6:
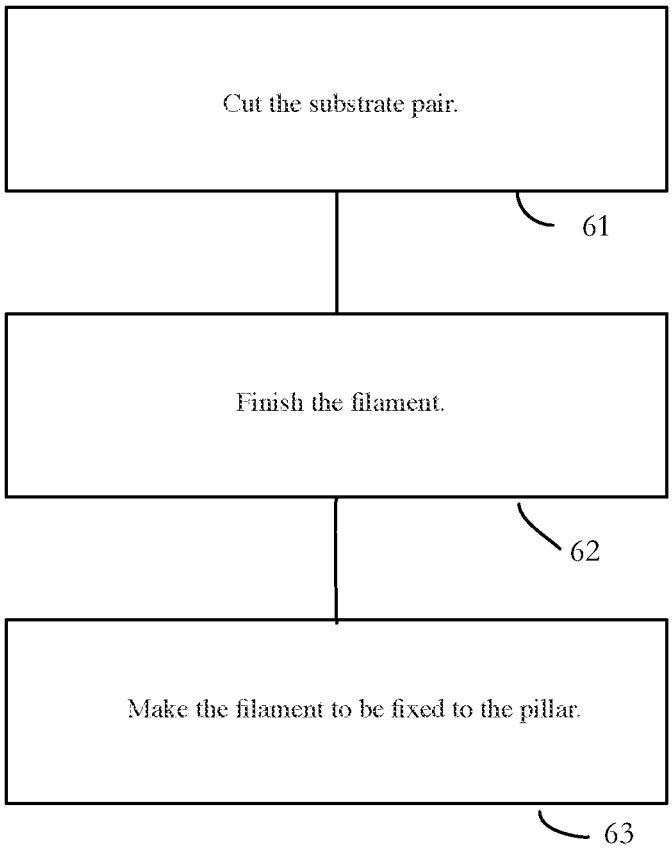
FIG. 6 is a flowchart of a manufacturing method of a lighting device.

Please refer to FIG. 6. The present invention provides a manufacturing method of a lighting device according to another view of the present invention. The manufacturing method includes steps as follows.

Cut a metal plate to produce the substrate, the top extended electrode, and the bottom extended electrode of the filament modules (step 61).

A filament module is provided (step 62). The filament module includes at least two filaments. The filament includes a substrate, multiple LED chips, a phosphor film, a top extended electrode, and a bottom extended electrode. Multiple LED chips are mounted on the substrate. The phosphor film covers the substrate and multiple LED chips. The top extended electrode and bottom extended electrode are connected to two ends of the substrate respectively. At least part of top extended electrode and bottom extended electrode are not covered by the phosphor film. Each top extended electrode of the filaments is fixed together.

One or multiple filament modules are fixed to the pillar of the lighting device (step 63). The pillar is mounted on the base of the lighting device.

In some embodiments, this manufacturing method further includes a producing way of cutting a metal plate to produce the substrate, the top extended electrode, and the bottom extended electrode of the filament modules.

According to different embodiments as above, the present invention makes it possible to decrease the cost with varying degrees, improve the stability of filaments, and simplify the production process.

In addition to embodiments as above, the present invention may have other applications or designs, and as long as they are within the spirit of the present invention, the various designs still belong to the scope of the present invention.

The invention claimed is:

1. A LED light bulb, comprising:

multiple filaments, wherein each filament comprises a substrate, multiple LED chips, a phosphor film on two sides of the substrate, a top extended electrode, and a bottom extended electrode, multiple LED chips are mounted on the substrate, the phosphor film covers the substrate and multiple LED chips, the top extended electrode and the bottom extended electrode are connected to two ends of the substrate respectively, at least part of the top extended electrode and the bottom extended electrode are not covered by the phosphor film, and each top extended electrode of the filaments is fixed together;

a base;

at least one pillar, wherein the bottom of the pillar is connected to the base, multiple top extended electrodes of the multiple filaments hang on the top of the pillar; and a base, wherein the base contains the driver circuit, the base is used to connect to the power, wherein the top of the pillar is used to support the multiple filaments.

2. The LED light bulb of claim 1, wherein multiple top extended electrodes of the multiple filaments connect to each other, then the combination of multiple top extended electrodes connects to the top of the pillar.

3. The LED light bulb of claim 1, wherein multiple top extended electrodes of the multiple filaments are integrally formed.

4. The LED light bulb of claim 3, wherein a connection of the top extended electrodes of the multiple filaments have a ring, the ring is put into the top of the pillar.

5. The LED light bulb of claim 1, wherein the top extended electrodes of the multiple filaments have a ring, the ring is put into the top of the pillar.

6. The LED light bulb of claim 1, wherein the number of the pillar is more than two, and the multiple filaments hang on the tops of the pillars.

7. The LED light bulb of claim 1, wherein the pillar is a thin piece of metal.

8. The LED light bulb of claim 1, wherein an insulation part of the top of the pillar is made of glass.

9. The LED light bulb of claim 1, wherein the pillar in the area of insulation part is all made of glass.

10. The LED light bulb of claim 1, wherein an insulation part of the top of the pillar is made of plastic.

11. The LED light bulb of claim 1, wherein the support structure of the pillar is a slot at an insulation part of the top of the pillar.

12. The LED light bulb of claim 1, wherein the support part of the pillar is an extended component set in an insulation part of the top of the pillar.

13. The LED light bulb of claim 12, wherein the extended component is a metal stick, the extended component includes an inner part and an extended part, the inner part of the extended component is set in the insulation part, the extended part of the extended component is stretched away from the insulation part, the top extended electrodes of the multiple filaments hang on the extended part of the extended component.

14. The LED light bulb of claim 1, further comprising a bottom electrical connection structure, the bottom electrical connection structure extends from the base, the bottom electrical connection structure electrically connects to the driver circuit, the bottom extended electrodes of the multiple filaments electrically connect to the bottom electrical connection structure, and the multiple filaments are electrically connected in series or parallel.

15. The LED light bulb of claim 14, wherein the bottom electrical connection structure has an annular metallic strip, by cutting off the annular metallic strip, the multiple filaments are electrically connected in series or parallel.

16. The LED light bulb of claim 15, wherein the bottom extended electrodes of the multiple filaments are fixed to the bottom electrical connection structure and thus to allow the angle between each filament and the pillar to be more than fifteen degrees.

* * * * *